US005920967A

United States Patent [19]

Souza

[11] Patent Number: 5,920,967

[45] Date of Patent: Jul. 13, 1999

[54] COMBINATION HOLDER AND SQUEEZING DEVICE FOR TUBE DISPENSERS

[76] Inventor: Augustine Souza, 707 W. Santa Ana, Apt. 103, Anaheim, Calif. 92805

[21] Appl. No.: 08/920,189

[22] Filed: Aug. 25, 1997

[51] Int. Cl.[6] ..... A44B 21/00; B65D 35/00

[52] U.S. Cl. ..... 24/563; 24/545; 222/103

[58] Field of Search ..... 24/563, 543, 531, 24/545, 546; 222/102, 103

[56] References Cited

U.S. PATENT DOCUMENTS

| | | | |
|---|---|---|---|
| D. 251,124 | 2/1979 | Takeuchi . | |
| 1,621,008 | 3/1927 | Fricker | 24/563 |
| 1,675,286 | 6/1928 | Van Valkenburg | 24/563 |
| 2,390,314 | 12/1945 | Massey | 222/103 |
| 3,463,359 | 8/1969 | Piggush | 222/103 |
| 4,030,636 | 6/1977 | Drancourt . | |
| 4,159,787 | 7/1979 | Wright . | |
| 4,203,567 | 5/1980 | Featherstone . | |
| 4,807,782 | 2/1989 | Meinerding et al. . | |
| 5,442,839 | 8/1995 | Miller . | |
| 5,549,221 | 8/1996 | Conlee | 24/563 |

*Primary Examiner*—Victor N. Sakran
*Attorney, Agent, or Firm*—Roy A. Ekstrand

[57] ABSTRACT

A holder includes a generally cylindrical barrel portion having an opening formed in the walls thereof. A pair of angularly related generally planar plates are joined to each side of the opening formed in the cylindrical portion to form a diverging angle between the plates. A conventional container/dispenser such as a toothpaste tube is received between the plates and extends therebeyond such that the closed end and a flattened portion of the tube passes through the opening and is coiled within the barrel portion. The material within the tube container/dispenser may be dispensed by squeezing the angularly disposed plates inwardly toward each other in an action which forces material from the tube interior while gripping and further coiling the flattened end of the tube. In an alternate embodiment, the holder further includes a supporting leg which extends downwardly from the barrel to support the combination of the holder and a tube container/dispenser in a vertical orientation.

17 Claims, 3 Drawing Sheets

COMBINATION HOLDER AND SQUEEZING DEVICE FOR TUBE DISPENSERS

FIELD OF THE INVENTION

This invention relates generally to squeezable tube container/dispensers for holding and dispensing viscous paste-like materials and particularly to apparatus for maintaining the tube contents at the net end of the squeezable tube.

BACKGROUND OF THE INVENTION

One of the most well known and pervasive product container/dispensers within the marketplace is the squeezable tube. This simple device also known by other names such as deformable tube, dispensing tube, or toothpaste tube has become the container of choice for most viscous commercial or industrial materials. Such tubes are often referred to generically as "toothpaste tubes" because of their initial popularity in the packaging of toothpaste products. However, despite this generic use of the term toothpaste tubes, such squeezable container/dispensers are used in a virtually endless number of products. Without exaggeration, one can say that squeezable tubes have been used to package and dispense virtually every viscous paste-like material such as adhesive, hair products, gels, ointments, caulk and so on.

The basic structure of such squeezable tubes is deceptively simple in that they utilize a long somewhat cylindrical hollow tube formed of a flexible material and having one end closed and the other end joined to a head which supports a neck or spout for dispensing. The neck or spout is usually cylindrical and usually defines a circular bore therethrough. However, certain materials are provided in cone-shaped or tapered neck structures. The closed end of the tube is usually formed by simply flattening and sealing the bottom end. A closure of the spout is provided by a removable cap usually through the use of cooperating threads or snap-fit apparatus. In still other tubes, however, the cap is configured to remain secured to the spout and is provided with an independent snap-fitted usually pivotally secured cap. In the early manufacture of such squeezable tubes, the tube was fabricated of a ductile metal or very thick foil material. However, in recent years, a greater number of squeezable tubes are manufactured using a flexible plastic tube material.

The use of squeezable tubes for a container/dispenser is deceptively simple in that the contents are dispensed by removing the cap and squeezing the tube portion with sufficient force to extrude the contents outwardly through the spout. As the contents are dispensed, the tube tends to flatten.

Despite the basic simplicity of the use of squeezable tube container/dispensers, often vexing problems arise as the material within the tube is dispensed. The flattening of the tube is not controlled and thus simply flattens wherever squeezed. As time goes by, the contents tend to be distributed unevenly throughout the flattening tube. As a result, the user must periodically, if not continuously, manipulate the tube to flatten the partially filled tube from the closed end bottom toward the head end. This process is necessary to avoid undesired waste and uneven distribution of the material within the tube. Failure to maintain the flattening of the tube from the bottom can make effective even dispensing of the contents virtually impossible.

Notsurprisingly, practitioners in the art have recognized the problems associated with effective use of squeezable tube container/dispensers and have produced a variety of devices to be used in combination with squeezable tubes.

For example, U.S. Pat. No. 4,159,787 issued to Wright sets forth a CLAMP FOR TUBE DISPENSERS having upper and lower arm portions defining a straight trailing side and a forward side having a curved portion. The members are joined at each end and spaced apart to maintain separation which facilitates inserting the flattened closed end of a tube through the space between arm members. As the contents are exhausted in the tube, the clamp is progressively moved upwardly toward the head end.

U.S. Pat. No. 4,030,636 issued to Drancourt sets forth a TUBE SQUEEZING DEVICE having two jaws pivotally connected to each other which each jaw providing a squeezing cylinder. The tube is held between the two cylinders and means are provided for rotation of one of the squeezing cylinders to advance the device along the tube. Means are also provided for preventing reverse movement of the device as it is squeezed over the tube.

U.S. Pat. No. 5,442,839 issued to Miller sets forth a CONTROL CLIP FOR USE WITH A TOOTHPASTE TUBE formed of a resilient material having an integrally attached front and back member. The front member terminates in an inwardly depending lip which, when engaging the edge of a fold made in the emptied portion of a tube, prevents the coil from unfolding and the tube from slipping from the clip. In the use of the control clip, the user periodically rolls the unused end of the container tube into a flattened roll and thereafter slips the clip onto the tube to contain the flattened roll.

U.S. Pat. No. 4,807,782 issued to Meinerding, et al. sets forth a CONTENTS-SAVER PLASTIC DISPENSING TUBE having a resilient means such as a rubber band attached to the bottom of the tube to prevent the bottom of the tube from unwinding after it has been wound.

U.S. Pat. No. 4,203,567 issued to Featherstone sets forth a COLLAPSIBLE TUBE HOLDING BRACKET for retaining a tube on a vertical wall surface having a flat supporting plate adjustably and movably adhered to a wall surface. A spring clip is positioned to clamp the closed end of an inverted tube and secure it to the plate. A L-shaped bracket is secured to the plate beneath the clamp and defines an aperture for receiving the tube neck.

U.S. Pat. No. Des. 251,124 issued to Takeuchi sets forth a PAPER CLIP having a flat plate defining a generally rectangular shape supporting a resilient spring clip secured to one edge of the plate. The removing end of the spring clip defines a curved grasping edge extending toward the plate.

While the foregoing described prior art devices have to some extent improved the art and have in some instances enjoyed commercial success, there remains nonetheless a continuing need in the art for a low cost, effective and easy to use holder and squeezing device for tube dispensers.

SUMMARY OF THE INVENTION

Accordingly, it is a general object of the present invention to provide an improved combination holder and squeezing device for tube dispensers. It is a more particular object of the present invention to provide an improved combination holder and squeezing device for tube dispensers which may be manufactured of low cost plastic material. It is a still more particular object of the present invention to provide an improved combination holder and squeezing device for tube dispensers which is easy to secure to a squeezable tube and which automatically maintains the depleted end of a squeezable tube in a compact configuration.

In accordance with the present invention, there is provided a holder and squeezing device for receiving and holding a tube dispenser/container having a flexible tube defining a flattened end and a head end supporting a neck, the device comprising: a barrel portion defining an interior surface and an opening; a first plate joined to the barrel portion at one side of the opening; a second plate joined to the barrel portion at the remaining side of the barrel portion; and an edge extending from the second plate toward the interior surface, the barrel portion, the opening, the edge and the first and second plates being constructed to receive the lower end through the opening beneath the edge and the first and second plates supporting opposed sides of the flexible tube.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
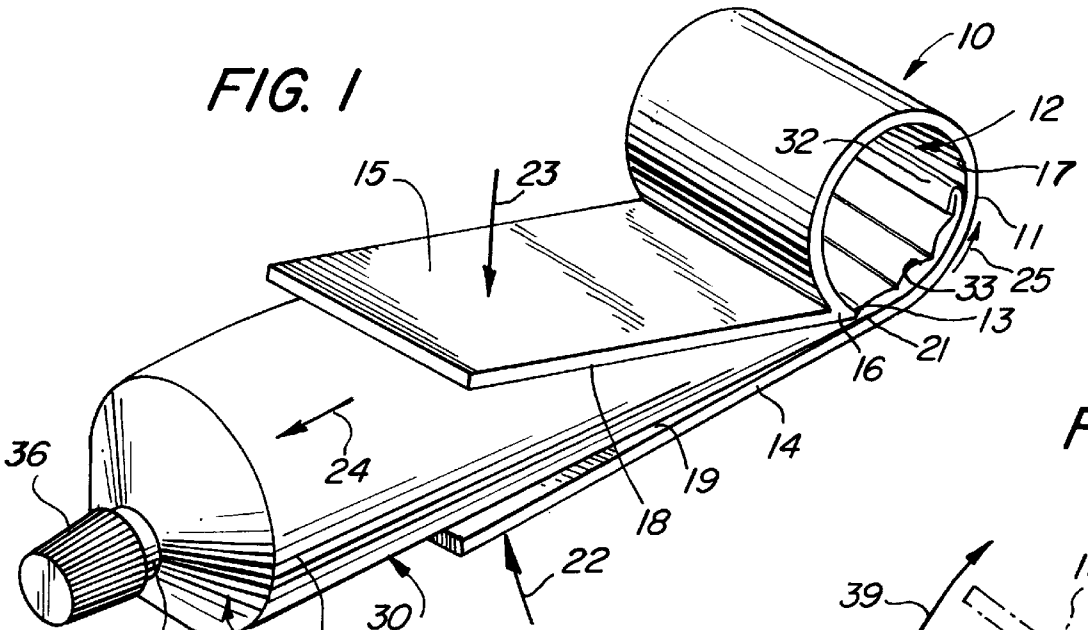
FIG. 1 sets forth a perspective view of a combination holder and squeezing device for tube dispensers having a conventional tube secured therein.

FIG. 1 sets forth perspective view of a combination holder and squeezing device for tube dispensers constructed in accordance with the present invention and generally referenced by numeral 10. Holder 10 is shown coupled to a conventional squeezable tube container/dispenser generally referenced by numeral 30. In accordance with conventional fabrication techniques, squeezable container/dispenser 30 includes a hollow flexible tube 31 formed of a flexible plastic or, alternatively, a deformable material such as ductile metal or the like. Flexible tube 31 defines a flattened closed end 32 sealing one end of flexible tube 31 and a head end 34. The latter supports a cylindrical neck 35 to which a cap 36 is secured. As mentioned, squeezable container/dispenser is fabricated entirely in accordance with conventional fabrication techniques.

Tube holder 10 is preferably formed of a resilient plastic material or the like and defines a generally cylindrical barrel portion 11 having an interior passage 12 defined therein. Barrel 11 further defines a curved inner surface 17. Tube holder 10 further includes a plate 14 defining a generally planar member extending from barrel portion 11. Tube holder 10 further includes a planar plate 15 joined to barrel portion 11 at a junction 16. Barrel portion 11 further defines an open gripping edge 13. Thus, while barrel 11 is preferably formed of a generally cylindrical member integrally formed with plates 14 and 15, barrel 11 is not a continuous cylinder but rather defines an opening 21 alongwhich gripping edge 13 is formed.

In accordance with the present invention and as is illustrated below in FIG. 2, closed end 32 of squeezable container/dispenser 30 is received within barrel portion 11 of tube holder 10 passing through opening 21 beneath gripping edge 13. In the configuration shown in FIG. 1, a portion of the contents of container/dispenser 30 have been previously used and as a result a portion of flexible tube 31 forms a flattened tube portion 33.

In accordance with the present invention and as is described below in greater detail, tube holder 10 is fitted upon flexible tube 31 of container/dispenser 30 such that the flattened portion extending from closed end 32 passes through opening 21 and is gripped by gripping edge 13. It will be apparent to those skilled in the art that, initially when flexible tube 31 is completely filled with viscous material, only the bottommost portion of closed end 32 is received beneath gripping edge 13 and extends through opening 21. Thereafter as the contents of container/dispenser 30 become used or dispensed, the extent of flattened tube portion 33 is correspondingly increased and closed end 32 as well as flattened tube portion 33 extend correspondingly into barrel portion 11 and conform generally to inner surface 17 thereof.

In operation and in accordance with the present invention, the user assembles container/dispenser 30 within tube holder 10 as described below in FIG. 2 in greater detail. Suffice it to note here that container/dispenser 30 is inserted into tube holder 10 to the position shown in FIG. 1 wherein surfaces 18 and 19 of plates 15 and 14 respectively are maintained in contact with the outer surfaces of flexible tube 31. As is also described below in greater detail, closed end 32 and whatever portion constitutes flattened tube 33 pass through opening 21 and are gripped by gripping edge 13. With container/dispenser 30 thus secured within tube holder 10, the combined apparatus is available for operation. In the dispensing of material from container/dispenser 30, the user removes cap 36 exposing the aperture of neck 35 (not shown) and thereafter squeezes plates 14 and 15 together as indicated by arrows 22 and 23 respectively. The inward force exerted upon plates 14 and 15 increases the pressure within flexible tube 31 and concurrently forces gripping edge 13 downwardly upon flattened tube portion 33 causing gripping edge 13 to further engage the underlying portion of flattened tube portion 33. As the user continues to squeeze plates 14 and 15 inwardly, the resulting pressure within flexible tube 31 together with the angular relationship between plates 14 and 15 forces the viscous material within flexible tube 31 forwardly in the direction indicated by arrow 24 toward neck 35. As this pressure is continued, a corresponding flow of viscous material is extruded outwardly through neck 35. Once the squeezing pressure on plates 14 and 15 is relaxed, the pressure within flexible tube 31 is relieved and the flow of material outwardly through neck 35 ceases. In accordance with the operation set forth below in FIGS. 3A through 3C in greater detail, and in accordance with an important aspect of the present invention, each squeezing movement of plates 14 and 15 produces a force upon flattened tube portion 33 imparted by gripping edge 13 which urges flattened tube portion 33 and closed end 32 in the direction indicated by arrow 25. As a result, the material within flexible tube 31 is progressively extruded with each cycle of squeezing and releasing plates 14 and 15 while gripping edge 13 operates to flatten the underlying portion of flexible tube 31 and moves flattened tube portion 33 into barrel 11 for convenient storage.

Figure 2:
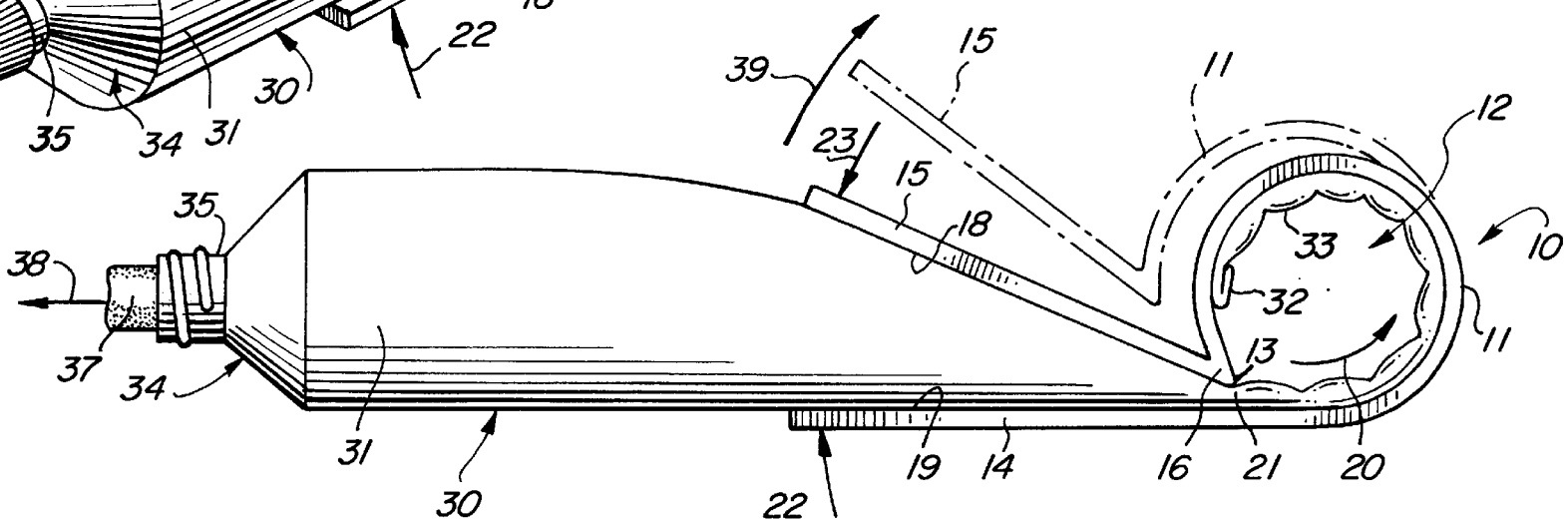
FIG. 2 sets forth a side elevation view of the combination holder and squeezing device of FIG. 1.

FIG. 2 sets forth a side elevation view of the present invention tube holder supporting a conventional squeezable container/dispenser 30. As described above, dispenser 30 is fabricated entirely in accordance with conventional fabrication techniques and thus includes a flexible tube 31, a head end 34, a neck 35 and a closed end 32. In the drawing of FIG. 2, a portion of flexible tube 31 is emptied of viscous material and thus forms flattened portion 33 of flexible tube 31.

In accordance with the present invention, tube holder 10 defines a generally cylindrical barrel 11 having an interior surface 17 and an interior passage 12 formed therein. In further accordance with the present invention, barrel 11 defines an open structure having an edge 13 formed therein. A generally planar plate 14 defining an inner surface 19 extends from barrel 11 and is integrally formed therewith. A second generally planar plate 15 defining an inner surface 18 is joined to barrel 11 at a junction 16. At junction 16, a gripping edge 13 is formed which extends downwardly toward surface 19 of plate 14. An opening 21 is formed between gripping edge 13 and the underlying surface of cylindrical portion 11 and plate 14.

In the preferred fabrication of the present invention, plates 14 and 15 together with cylindrical portion 11, junction 16 and gripping edge 13 are formed of a single integral member. Further in the preferred fabrication of the present invention, holder 10 is fabricated of a resilient plastic material. However, other materials such as spring steel or composite material may be utilized without departing from the spirit and scope of the present invention.

FIG. 2 also illustrates the typical tube attachment process to be utilized in the present invention. As shown in dashed-line representation, plate 15 may be pivoted away from plate 14 in the direction indicated by arrow 39 to the open dashed-line position shown. In this pivotal motion, the spring force of barrel portion 11 must be overcome. With plate 15 pivoted to the dashed-line position, the user simply inserts container/dispenser 30 into holder 10 and positions it such that flattened portion 33 is curled upon inner surface 17 of barrel portion 11 and the forwardmost portion of flattened portion 33 is positioned beneath gripping edge 13. The final positioning of container/dispenser 30 within holder 10 is adjusted as the user releases plate 15 allowing the spring force of barrel portion 11 to return it to the position shown in solid line representation in FIG. 2. The adjustment of position is undertaken to ensure that the forwardmost portion of flattened tube portion 33 is positioned beneath gripping edge 13. Once this has been done, the user may then undertake the above-described dispensing processor may allow holder 10 to provide a convenient retainer for container dispenser 30.

With cap 36 (seen in FIG. 1) removed from neck 35, the above-described dispensing process may take place as the user squeezes plates 14 and 15 together in the manner indicated by arrows 22 and 23. In further accordance with the present invention, the squeezing action upon plates 14 and 15 simultaneously accomplishes two highly synergistic effects. First, pressure is created within flexible tube 31 in a direction forcing the viscous material therein forwardly from the region between plates 14 and 15. Thus, the troublesome problem of remembering to squeeze the tube at the bottom which so often vexes people is eliminated. Holder 10 automatically provides the squeezing force at the bottom portion of flexible tube 31. In addition, the structure of barrel 11 and the position of gripping edge 13 cooperate to convert a portion of the force applied to plates 14 and 15 so as to act rearwardly upon the underlying gripped portion of flattened tube 33 urging flattened tube 33 in the direction indicated by arrow 20. Thus, with simultaneous action as the user repeatedly squeezes and releases plates 14 and 15, material is dispensed or extruded outwardly through neck 35 in the direction of arrow 38 forming a flow of material 37 while the emptied portion of tube 31 forms flattened tube portion 33 which is curled within barrel portion 11.

Figure 3A:
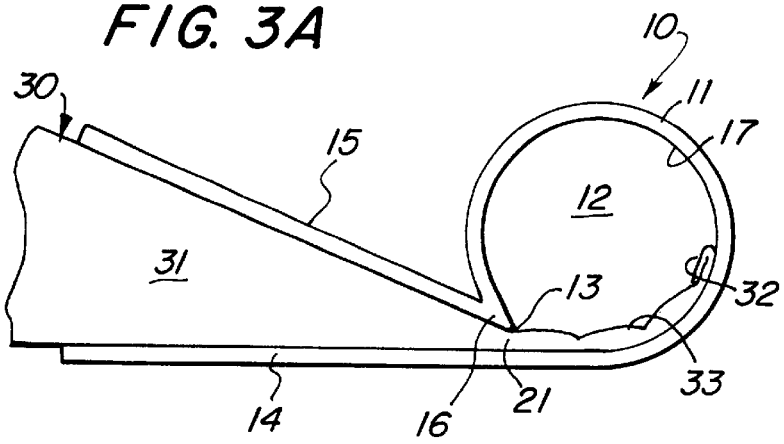
FIG. 3A, 3B and 3C set forth partial side views showing the sequential operation of the present invention combination holder and squeezing device for tube dispensers.
Figure 3B:
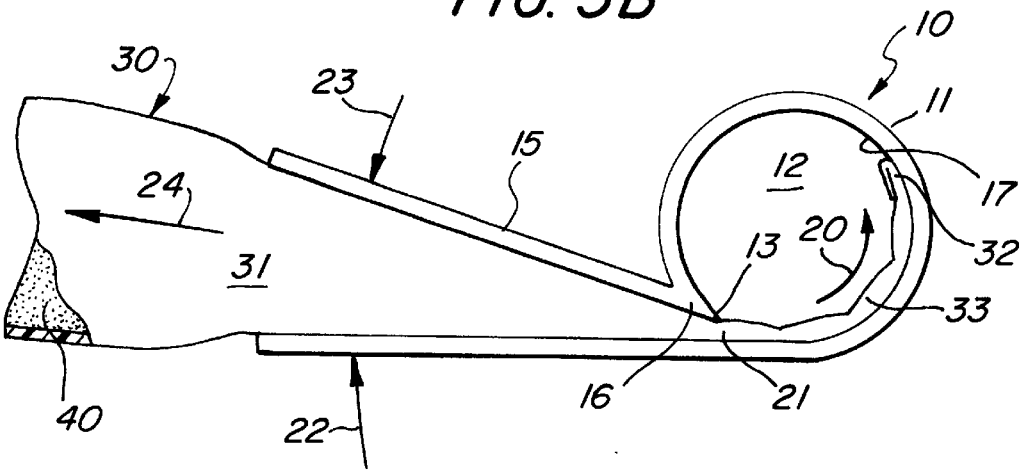
Figure 3C:
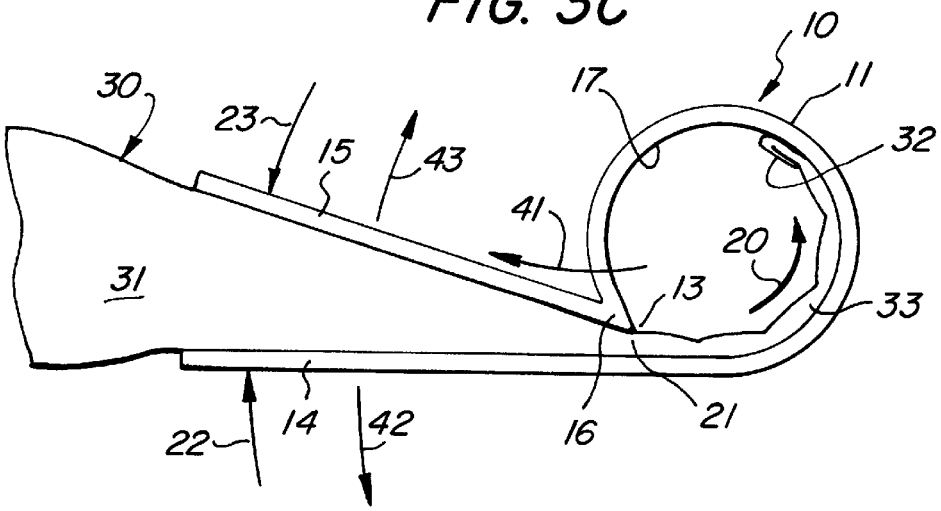

FIGS. 3A through 3C set forth simplified sequential diagrams of the flattened end movement and curling action provided by the present invention tube holder. FIG. 3A shows tube holder 10 in its normal or relaxed position while FIG. 3B shows tube holder 10 during the initiation of a squeezing action to dispense material. Finally, FIG. 3C shows tube holder 10 at the extreme of a material dispensing action.

More specifically, FIG. 3A shows tube holder 10 in the relaxed position having cylindrical barrel portion 11 defining interior surface 17 and interior passage 12. Holder 10 further includes generally planar plates 14 and 15 joined to cylindrical barrel portion 11 and junction 16 respectively. A gripping edge 31 is positioned above an opening 21 formed in cylindrical barrel portion 11. A flexible tube 31 of container/dispenser 30 extends between plates 14 and 15 having closed end 32 and flattened portion 33 passing through opening 21.

In the relaxed position shown, container/dispenser 30 is secured within holder 10 by the spring force of barrel 11 acting through gripping edge 13 and surface 17 upon flexible tube 31. The attachment of holder 10 is further supplemented by the pressure inwardly between plates 14 and 15 produced by the spring force of barrel portion 11. As a result, holder 10 contains and secures container/dispenser 30 allowing the combination thereof to be handled as a single unit.

More specifically, FIG. 3B shows tube holder 10 in the relaxed position having cylindrical barrel portion 11 defining interior surface 17 and interior passage 12. Holder 10 further includes generally planar plates 14 and 15 joined to cylindrical barrel portion 11 and junction 16 respectively. A gripping edge 31 is positioned above an opening 21 formed in cylindrical barrel portion 11. A flexible tube 31 of container/dispenser 30 extends between plates 14 and 15 having closed end 32 and flattened portion 33 passing through opening 21.

FIG. 3B shows the initial squeezing operation for dispensing material from container/dispenser 30 as the user squeezes plates 14 and 15 together in the direction indicated by arrows 22 and 23 respectively. The resulting pressure thus created begins to force the viscous material within tube 31 forwardly in the direction indicated by arrow 24. As mentioned above, this viscous material referenced by numeral 40 may comprise virtually any paste-like or highly viscous liquid ranging from commercial adhesives to medical applications to common toothpaste.

In accordance with an important aspect of the present invention, the action of plates 14 and 15 being squeezed together also forces gripping edge 13 downwardly upon the underlying portion of flattened end 33 of tube 31. Further, and in further accordance with the present invention, the inward movement of plate 15 with respect to plate 14 tightens the curvature of barrel portion 11 moving gripping edge 13 in the direction indicated by arrow 20. This further gripping and movement of edge 13 "bites into" the underlying portion of flattened tube 33 sliding flattened portion 33 along surface 17 of barrel 11 in the direction of arrow 20.

More specifically, FIG. 3C shows tube holder 10 in the relaxed position having cylindrical barrel portion 11 defining interior surface 17 and interior passage 12. Holder 10 further includes generally planar plates 14 and 15 joined to cylindrical barrel portion 11 and junction 16 respectively. A gripping edge 31 is positioned above an opening 21 formed in cylindrical barrel portion 11. A flexible tube 31 of container/dispenser 30 extends between plates 14 and 15 having closed end 32 and flattened portion 33 passing through opening 21.

FIG. 3C shows the configuration of tube holder 10 near the completion of a squeezing activity. Thus, once the user has squeezed plates 14 and 15 together in the directions indicated by arrows 22 and 23 and has dispensed the desired amount of material from within container/dispenser 30, the action described above in FIG. 3B has carried flattened end 33 into cylindrical portion 11 in the direction indicated by arrow 20. Thereafter, as the user releases plates 14 and 15, the resilient spring force of barrel portion 11 flexes barrel portion 11 outwardly as indicated by arrow 41 which in turn spreads plates 14 and 15 outwardly in the directions indicated by arrows 42 and 43 respectively. This spring force restores holder 10 to the relaxed position shown in FIG. 3A.

Figure 4:
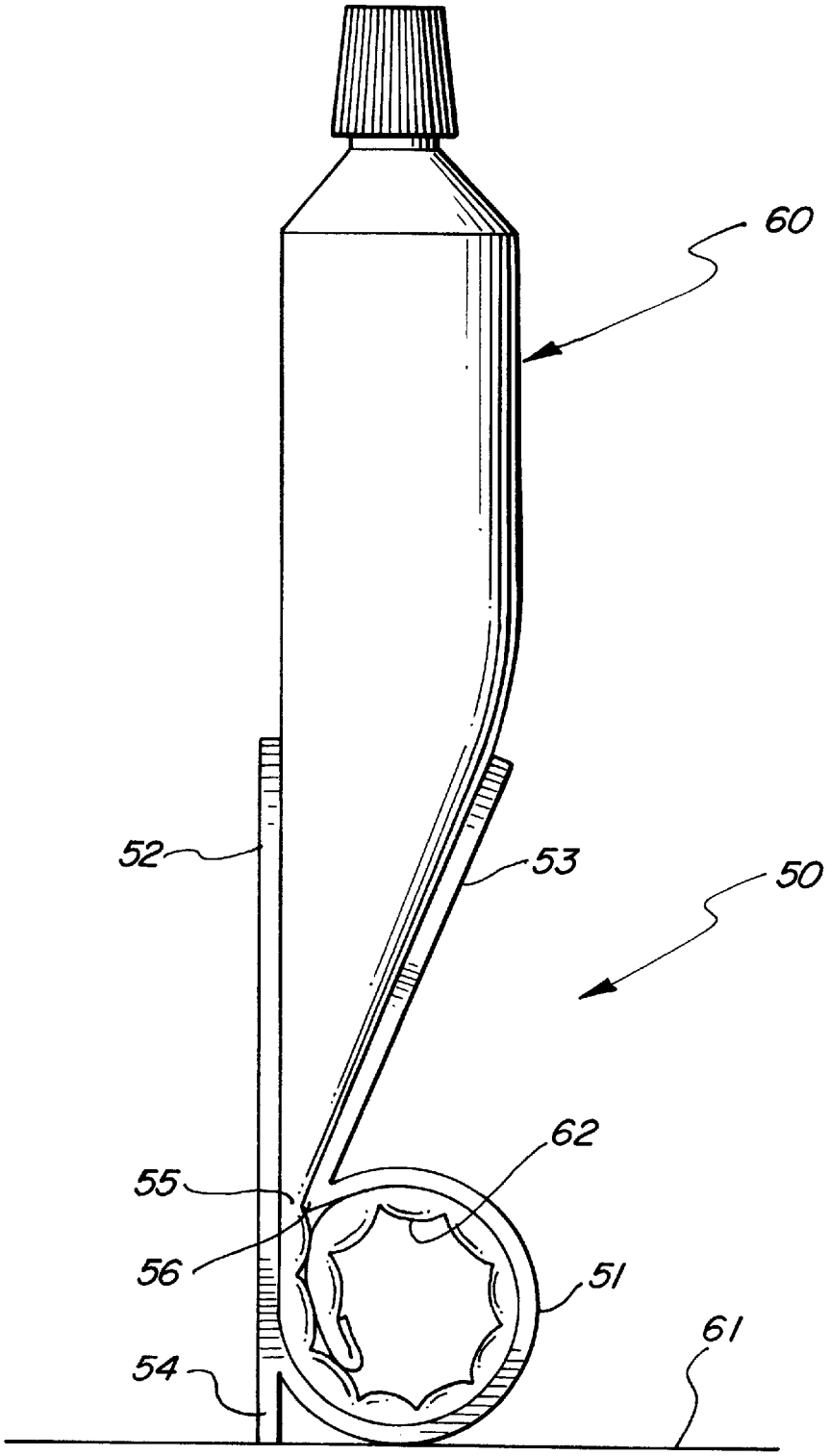
FIG. 4 sets forth a side elevation view of an alternate embodiment of the present invention combination holder and squeezing device for tube dispensers supporting a conventional squeezable tube therein.

In addition and in accordance with an important aspect of the present invention, edge 13 moves forwardly along flexible tube 31 as holder 10 returns to its relaxed position which moves edge 13 forwardly upon flexible tube 31 by a short distance which positions gripping edge 13 upon a slightly more forward position of flexible tube 31. As a result, gripping edge 13 now bites into the next portion of flexible tube 31 afterwhich another squeezing force applied to plates 14 and 15 results in the next inward movement in the direction of arrow 20 by flattened portion 33. Thus, in accordance with an important aspect of the present invention, successive motions of squeezing and release followed by subsequent squeezing and release works in a "ratchet-like" action which moves the depleted portion of tube 31 forming flattened portion 33 successively inwardly to form a spiral within barrel 11 such as illustrated in FIG. 4. In this manner, the entirety of tube 31 is utilized and successive often clumsy manipulations of the depleted end of the flexible tube otherwise occasioned by prior art devices is avoided.

FIG. 4 sets forth an alternate embodiment of the present invention combination holder and squeezing device for tube dispensers generally referenced by numeral 50. Holder 50 is substantially identical to holder 10 set forth above with the difference therebetween found in an extending leg 54. Thus, holder 50 includes a generally cylindrical barrel portion 51 forming an open spring-like member having a gripping edge 56 formed in the open portion thereof. Holder 50 further includes plates 52 and 53. In further similarity to the above-described embodiments, an opening 55 is formed between gripping edge 56 and plate 52. A flattened portion 62 extends into barrel portion 51 and is spiral wound therein in accordance with the above-described winding action. Leg 54 is, in essence, an extension of plate 52 joined to barrel portion 51 and extending beyond a sufficient distance to cooperate with barrel 51 in supporting holder 50 upon a surface 61. Thus, in accordance with a further aspect of the present invention, the embodiment shown in FIG. 4 as holder 50 is capable of standing vertically upon a horizontal surface while supporting a container/dispenser 60. In all other respects, however, holder 50 functions identically to holder 10 described above. The addition of leg 54 facilitates the vertical support of tube 60 and reduces the space upon surface 61 required to support the combination of holder 50 and container/dispenser 60.

It will be apparent to those skilled in the art that while a generally cylindrical shape for barrel portions 11 and 51 is shown as the preferred shape for the barrel portion of the present invention holder, other shapes having similar qualities may be utilized without departing from the spirit and scope of the present invention. For example, the barrel portion of holders 10 or 50 may employ shapes which define faceted structures such as decagons, octagons, hexagons and so on without departing from the spirit and scope of the present invention. Similarly, shapes may be utilized which are elliptical or nonsymmetrically rounded shapes. The essential feature of the shape of the barrel portion of the present invention is the provision of a spring force acting to urge the gripping edge supported at the opening of the barrel portion against the underlying flexible tube and the rearward movement to coil the flattened depleted portion of the flexible tube as the plates are squeezed together. As is also mentioned above, the preferred fabrication of the present invention is found in the use of a resilient plastic material or the like. However, it is recognized that other materials such as spring steel or the like may be employed in fashioning the present invention device without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A holder and squeezing device for receiving and holding a tube dispenser/container having a flexible tube defining a flattened end and a head end supporting a neck, said device comprising:

a barrel portion defining an interior tube-end curling surface and an opening;

a first plate joined to said barrel portion at one side of said opening to form a smooth sliding surface; and a second plate forming an acute angle with said first plate and joined to said barrel portion at the remaining side of said opening in saidbarrel portion forming a gripping edge at the junction of said second plate and said barrel portion, said barrel portion, said opening, said gripping edge and said first and second plates being constructed to receive said lower end through said opening beneath said edge and said first and second plates supporting opposed sides of said flexible tube.

2. The holder and squeezing device set forth in claim 1 wherein said barrel is generally cylindrical.

3. The holder and squeezing device set forth in claim 2 wherein said first and second plates form an angle therebetween which diverges in the direction away from said opening.

4. The holder and squeezing device set forth in claim 3 wherein said first and second plates are generally planar.

5. The holder and squeezing device set forth in claim 4 wherein said barrel and said first and second plates are formed of an integral unit.

6. The holder and squeezing device set forth in claim 5 wherein said first plate further defines a leg portion extending beyond said opening, said holder and squeezing device and a tube dispenser/container being capable of standing vertically with said head and pointed up while said leg portion and said barrel form a support.

7. The holder and squeezing device set forth in claim 1 wherein said first plate further defines a leg portion extending beyond said opening, said holder and squeezing device and a tube dispenser/container being capable of standing vertically with said head and pointed up while said leg portion and said barrel form a support.

8. The holder and squeezing device set forth in claim 7 wherein said barrel is generally cylindrical.

9. The holder and squeezing device set forth in claim 8 wherein said first and second plates form an angle therebetween which diverges in the direction away from said opening.

10. The holder and squeezing device set forth in claim 9 wherein said first and second plates are generally planar.

11. The holder and squeezing device set forth in claim 10 wherein said barrel and said first and second plates are formed of an integral unit.

12. A holder and squeezing device constructed to receive and grip the flattened end and lower tube portion of a tube container/dispenser, said device comprising:

a barrel defining an elongated opening and an interior surface; and a pair of plates one of said plates being joined to said barrel at one side of said opening to form an acute angle therebetween and a gripping edge while the remaining one of said plates is joined to the other side of said opening in said barrel at a generally tangent angle to said barrel, said barrel and said plates constructed to receive the flattened end of a tube container/dispenser through said opening and onto said surface and to grasp opposed sides of the lower tube portion thereof whereby the tube container/dispenser when squeezed by squeezing said plates together expels a portion of the contents of said container/dispenser.

13. The holder and squeezing device set forth in claim 12 wherein one of said plates defines a gripping edge which presses into the flattened end of the tube container/dispenser and which moves inwardly of said barrel when said plates are squeezed together urging the flattened end into said barrel and causing it to coil therein as the contents of the tube container/dispenser are depleted.

14. The holder and squeezing device set forth in claim 13 wherein said barrel is generally cylindrical.

15. The holder and squeezing device set forth in claim 14 wherein said plates are generally planar.

16. A holder and squeezing device for receiving a lower portion and flattened end of a tube container dispenser, said device comprising:

a generally cylindrical barrel defining an opening therethrough having first and second edges on each side thereof;

a first plate joined to said first edge in a tangential relationship to said barrel forming a generally continuos sliding surface extending from said first plate to said barrel and a second plate joined to said second edge in an acute angle relationship to said barrel forming a gripping edge junction therebetween for engaging said tube container/dispenser when said plates are squeezed, said barrel, said first plate and said second plate cooperating to receive a flattened end of a tube container/dispenser through said opening and to grip a lower portion of a tube container/dispenser between said first and second plates.

17. The holder and squeezing device set forth in claim 16 wherein said barrel and said second plate form a gripping edge for gripping a flattened end of a tube container/dispenser and wherein said barrel is resilient and forms a spring urging said edge toward said first plate.

* * * * *